US012612575B2

(12) United States Patent
Grundei et al.

(10) Patent No.: US 12,612,575 B2
(45) Date of Patent: Apr. 28, 2026

(54) LUBRICATING GREASE COMPOSITION CONTAINING AN IONIC FLUID

(71) Applicant: KLUEBER LUBRICATION MUENCHEN GMBH & CO. KG, Munich (DE)

(72) Inventors: Stefan Grundei, Mering (DE); Daniel Chall, Stadtbergen (DE); Martin Schmidt-Amelunxen, Röhrmoos/Arzbach (DE)

(73) Assignee: KLUEBER LUBRICATION MUENCHEN GMBH & CO. KG, Munich (DE)

( * ) Notice: Subject to any disclaimer, the term of this patent is extended or adjusted under 35 U.S.C. 154(b) by 0 days.

(21) Appl. No.: 18/997,186

(22) PCT Filed: May 11, 2023

(86) PCT No.: PCT/EP2023/062567
§ 371 (c)(1),
(2) Date: Jan. 21, 2025

(87) PCT Pub. No.: WO2024/017518
PCT Pub. Date: Jan. 25, 2024

(65) Prior Publication Data

US 2025/0257280 A1 Aug. 14, 2025

(30) Foreign Application Priority Data

Jul. 21, 2022 (EP) ..... 22186355

(51) Int. Cl.
*C10M 169/00* (2006.01)
*C10M 105/36* (2006.01)
(Continued)

(52) U.S. Cl.
CPC ..... *C10M 169/00* (2013.01); *C10M 105/36* (2013.01); *C10M 107/34* (2013.01);
(Continued)

(58) Field of Classification Search
CPC ..... C10M 169/00; C10M 105/36; C10M 107/34; C10M 115/08; C10M 117/06;
(Continued)

(56) References Cited

U.S. PATENT DOCUMENTS

2010/0105586 A1 4/2010 Bodesheim et al.
2012/0202724 A1* 8/2012 Bodesheim ..... C10M 133/48 508/504
(Continued)

FOREIGN PATENT DOCUMENTS

EP 2164935 B1 12/2015
EP 3872154 A1 9/2021
(Continued)

*Primary Examiner* — Prem C Singh
*Assistant Examiner* — Francis C Camplanell
(74) *Attorney, Agent, or Firm* — LEYDIG, VOIT & MAYER, LTD.

(57) ABSTRACT

A lubricating grease composition, including 20 to 96.5 wt %, relative to a total weight of the lubricating grease composition, of a base oil, the base oil containing a basic oil A in a proportion of at least 50 wt %, relative to a total weight of the base oil, wherein the basic oil A is an ester and/or a polyglycol containing unsubstituted ethylene units as a carbon group in a repeating unit. The lubricating grease composition further includes 0.5 to 80 wt %, relative to the total weight of the lubricating grease composition, of an ionic liquid, the anion of the ionic liquid being bis(fluorosulfonyl)imide and 3 to 35 wt %, relative to the total weight of the lubricating grease composition, of a thickener selected from urea, lithium simple soaps, metal complex soaps of
(Continued)

elements of the first and second main group of the periodic table, lithium complex soaps, and mixtures thereof.

27 Claims, 2 Drawing Sheets

(51) Int. Cl.

| | |
|---|---|
| ***C10M 107/34*** | (2006.01) |
| ***C10M 115/08*** | (2006.01) |
| ***C10M 117/06*** | (2006.01) |
| ***C10M 133/12*** | (2006.01) |
| ***C10M 137/14*** | (2006.01) |
| ***C10M 141/10*** | (2006.01) |
| *C10N 30/02* | (2006.01) |
| *C10N 50/10* | (2006.01) |

(52) U.S. Cl.
CPC ..... *C10M 115/08* (2013.01); *C10M 117/06* (2013.01); *C10M 133/12* (2013.01); *C10M 137/14* (2013.01); *C10M 141/10* (2013.01); *C10M 2207/1276* (2013.01); *C10M 2207/2855* (2013.01); *C10M 2209/1075* (2013.01); *C10M 2215/064* (2013.01); *C10M 2215/1026* (2013.01); *C10M 2223/065* (2013.01); *C10N 2030/02* (2013.01); *C10N 2050/10* (2013.01)

(58) Field of Classification Search
CPC ..... C10M 133/12; C10M 137/14; C10M 141/10; C10M 2207/1276; C10M 2207/2855; C10M 2209/1075; C10M 2215/064; C10M 2215/1026; C10M 2223/065; C10N 2030/02; C10N 2050/10
USPC ..... 508/388
See application file for complete search history.

(56) References Cited

U.S. PATENT DOCUMENTS

| | | | | |
|---|---|---|---|---|
| 2013/0053287 | A1 | 2/2013 | Honda et al. | |
| 2014/0128300 | A1* | 5/2014 | Hayama ..... | C10M 169/02 508/552 |
| 2021/0253972 | A1 | 8/2021 | Seemeyer et al. | |

FOREIGN PATENT DOCUMENTS

| | | | |
|---|---|---|---|
| JP | 2007154183 | A | 6/2007 |
| JP | 2008133309 | A | 6/2008 |
| JP | 2011174050 | A | 9/2011 |
| JP | 2016056380 | A | 4/2016 |
| WO | 2009/113677 | A1 | 9/2009 |

* cited by examiner

LUBRICATING GREASE COMPOSITION CONTAINING AN IONIC FLUID

CROSS REFERENCE TO RELATED APPLICATIONS

This application is a U.S. National Phase application under 35 U.S.C. § 371 of International Application No. PCT/EP2023/062567, filed on May 11, 2023, and claims benefit to European Patent Application No. EP 22186355.8, filed on Jul. 21, 2022. The International Application was published in German on Jan. 25, 2024 as WO 2024/017518 A1 under PCT Article 21(2).

FIELD

The present invention relates to a lubricating grease composition containing an ionic liquid, and to the use thereof.

BACKGROUND

It is known that ionic liquids can be used as additives in lubricants, such as lubricating greases and lubricating oils. This makes it possible to advantageously influence tribologically relevant properties such as friction, wear, and electrical conductivity. Good results are achieved in particular with ionic liquids which have CFx-containing groups. These groups are usually present in the anions and, as additives in lubricants, improve the thermal resilience and electrical conductivity of these lubricants. Because of its very good heat and hydrolysis resistance, bis(trifluoromethylsulfonyl)imide (bta) is an important example of these anions.

However, one disadvantage of compounds containing CFx is that these groups are not biodegradable, and therefore ionic liquids containing such groups are persistent.

A lubricant composition is known from EP3872154 (A1), comprising a) a lubricant, in particular containing a non-polar basic oil, b) a first ionic liquid which is soluble in polyalphaolefin (PAO), in particular in PAO 400/40, produced from 1-decene as the monomer component, c) a second ionic liquid which is insoluble in polyalphaolefin (PAO), in particular in PAO 400/40, produced from 1-decene as the monomer component.

Trihexyl(tetradecyl)phosphonium bis(fluorosulfonyl) imide is mentioned among others as a potential second ionic liquid. However, those skilled in the art know that ionic liquids based on bis(fluorosulfonyl)imide (fsi) as the anion have considerably lower thermal resistance than ionic liquids having CFx-containing groups. This can mainly be explained by the fact that the fsi anion lacks strong carbon-fluorine bonds, which has an overall negative effect on the stability of the molecule.

Another disadvantage of the described lubricant composition is that using two different ionic liquids increases the complexity of the production process and consequently increases the production costs; in addition, the lubricant composition is limited to non-polar basic oils. Although the non-polar basic oils may have a polar component, this is always less than 50 wt % relative to the total weight of the basic oil.

EP2164935B1 describes the use of selected ionic liquids having fluorine-containing anions in lubricating grease compositions for reducing the appearance of aging of the lubricant and for reducing the electrical resistance.

SUMMARY

In an embodiment, the present disclosure provides a lubricating grease composition, comprising 20 to 96.5 wt %, relative to a total weight of the lubricating grease composition, of a base oil, the base oil containing a basic oil A in a proportion of at least 50 wt %, relative to a total weight of the base oil, wherein the basic oil A is an ester and/or a polyglycol containing unsubstituted ethylene units as a carbon group in a repeating unit. The lubricating grease composition further comprises 0.5 to 80 wt %, relative to the total weight of the lubricating grease composition, of an ionic liquid, the anion of the ionic liquid being bis(fluorosulfonyl)imide and 3 to 35 wt %, relative to the total weight of the lubricating grease composition, of a thickener selected from urea, lithium simple soaps, metal complex soaps of elements of the first and second main group of the periodic table, lithium complex soaps, and mixtures thereof.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
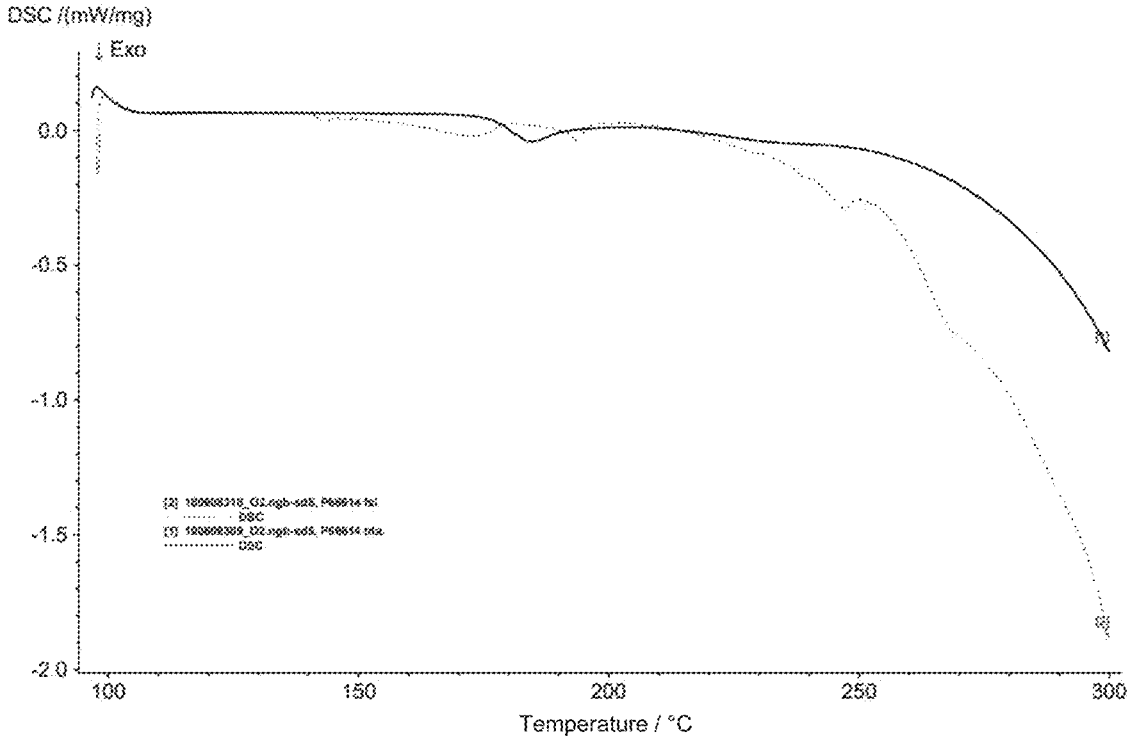
FIG. 1 shows results of DSC measurements under an $O_2$ atmosphere.

In an embodiment, the present disclosure provides a lubricant composition which can do away with the use of ionic liquids containing bta and which nevertheless has good tribologically relevant properties in respect of friction, wear, and electrical conductivity. Furthermore, the lubricant composition should have sufficient temperature stability, preferably of at least 180° C., and be able to contain a high proportion of polar basic oils.

The foregoing is achieved by a lubricating grease composition comprising:

a) 20 to 96.5 wt %, relative to the total weight of the lubricating grease composition, of a base oil, the base oil containing a basic oil A in a proportion of at least 50 wt %, relative to the total weight of the base oil, wherein the basic oil A is an ester and/or a polyglycol, preferably a polyglycol, containing unsubstituted ethylene units as the carbon group in the repeating unit, b) 0.5 to 80 wt %, relative to the total weight of the lubricating grease composition, of an ionic liquid, the anion of which is bis(fluorosulfonyl)imide, c) 3 to 35 wt %, relative to the total weight of the lubricating grease composition, of a thickener selected from urea, lithium simple soaps, metal complex soaps of elements of the first and second main group of the periodic table, in particular lithium complex soaps, and mixtures thereof.

According to the present disclosure, it has been found that the lubricating grease composition according to the present disclosure makes it possible to do away with using bta-containing ionic liquids but still to obtain good tribologically relevant properties in respect of friction, wear, and electrical conductivity. Furthermore, it is possible for the lubricating grease composition to contain a high proportion of polar basic oils, and it also has sufficient temperature stability, preferably of at least 180° C. The high temperature stability of the lubricating grease composition according to the present disclosure was surprising, since ionic liquids based on bis(fluorosulfonyl)imide as the anion are known to have only low thermal stability. Without establishing a particular mechanism, it is assumed that the surprisingly high thermal stability of bis(fluorosulfonyl)imide as the anion in the lubricant according to the present disclosure can be attributed to solubilization by the base oil, which has a stabilizing effect. It is also conceivable that stabilization is achieved by the base oil suppressing or delaying autocatalytic effects.

According to the present disclosure, the lubricating grease composition preferably comprises a base oil which has a solubility, at a room temperature of 20° C., for the ionic liquid methyl trioctylammonium bis(fluorosulfonyl)imide of at least 3 wt %. This solubility demonstrates the high polarity of the base oil. Furthermore, the basic oil A preferably also has a solubility, at a room temperature of 20° C., for the ionic liquid methyl trioctylammonium bis(fluorosulfonyl)imide of at least 3 wt %. The solubility for the ionic liquid methyl trioctylammonium bis(fluorosulfonyl)imide is preferably determined as described in the section on test methods.

The base oil can contain one or more basic oils A and optionally also basic oils which are different from the basic oil A. However, according to the present disclosure, the lubricating grease composition preferably does not have any further base oils in addition to the base oil.

In an embodiment of the present disclosure, the base oil has a solubility, at a room temperature of 20° C., for the ionic liquid methyl trioctylammonium bis(fluorosulfonyl)imide of at least 3 wt %, preferably at least 5 wt %, even more preferably at least 10 wt %.

In an embodiment of the present disclosure, the base oil has a solubility, at a room temperature of 20° C., for the ionic liquid methyl trioctylammonium bis(fluorosulfonyl)imide at least in the range from 3 wt % to 30 wt %, and/or at least in the range from 5 wt % to 30 wt %, and/or at least in the range from 10 wt % to 30 wt %, and/or at least in the range from 3 wt % to 20 wt %, and/or at least in the range from 5 wt % to 20 wt %, and/or at least in the range from 10 wt % to 20 wt %, and/or at least in the range from 3 wt % to 15 wt %, and/or at least in the range from 5 wt % to 15 wt %, and/or at least in the range from 10 wt % to 15 wt %.

In an embodiment of the present disclosure, the basic oil A has a solubility, at a room temperature of 20° C., for the ionic liquid methyl trioctylammonium bis(fluorosulfonyl) imide of at least 3 wt %, preferably at least 5 wt %, even more preferably at least 10 wt %.

In an embodiment of the present disclosure, the basic oil A has a solubility, at a room temperature of 20° C., for the ionic liquid methyl trioctylammonium bis(fluorosulfonyl) imide at least in the range from 3 wt % to 99 wt %, and/or at least in the range from 5 wt % to 99 wt %, and/or at least in the range from 10 wt % to 99 wt %, and/or at least in the range from 3 wt % to 80 wt %, and/or at least in the range from 5 wt % to 80 wt %, and/or at least in the range from 10 wt % to 80 wt %, and/or at least in the range from 3 wt % to 15 wt %, and/or at least in the range from 5 wt % to 15 wt %, and/or at least in the range from 10 wt % to 15 wt %.

In a preferred embodiment, the basic oil A is present in a proportion of 50 to 100 wt % and/or in a proportion of more than 55 wt %, for example from 55 to 100 wt %, and/or in a proportion of more than 60 wt %, for example from 60 to 100 wt %, even more preferably in a proportion of more than 70 wt %, for example from 70 to 100 wt %, in each case relative to the total weight of the base oil.

The proportion of the base oil, relative to the total weight of the lubricating grease composition, is 20 wt % to 96.5 wt %, preferably 40 wt % to 95%, even more preferably 60 wt % to 90%, even more preferably 70 wt % to 95%, and in particular 75 wt % to 85 wt %.

The proportion of the basic oil A, relative to the total weight of the lubricating grease composition, is preferably 10 wt % to 96.5 wt %, even more preferably 35 wt % to 95% wt %, even more preferably 40 wt % to 90 wt %, in particular 35 wt % to 85 wt %.

In a preferred embodiment, the basic oil A is an ester and/or a polyglycol, wherein the polyglycol is preferably a polyglycol containing unsubstituted ethylene units as the carbon group in the repeating unit. A preferred polyglycol is a polyalkylene glycol containing unsubstituted ethylene units as the carbon group in the repeating unit, preferably a polyalkylene glycol containing unsubstituted ethylene units and methyl-substituted ethylene units as the carbon group in the repeating unit. Another preferred polyglycol is a polyalkylene glycol containing unsubstituted ethylene units as the carbon group in the repeating unit, wherein the proportion by weight of unsubstituted ethylene units is preferably at least 20 wt %, for example 20 wt % to 100 wt %, preferably at least 30 wt %, for example 30 wt % to 100 wt %, relative to the total weight of the polyglycol.

In a preferred embodiment, the ester has an oxygen/carbon weight ratio of more than 0.1, for example of 0.1 to 0.35, preferably of more than 0.15 to 0.30, and/or the polyglycol has an oxygen/carbon weight ratio of more than 0.44, for example of 0.44 to 0.70, preferably of more than 0.50, for example of 0.50 to 0.68.

A preferred polyglycol is selected from homopolymers of ethylene oxide as the sole monomer and/or copolymers having unsubstituted ethyl groups and 1-methylethyl groups as the carbon groups in the repeating unit, wherein the proportion by weight of unsubstituted ethylene units in the copolymers is preferably at least 20 wt %, for example 20 wt % to 90 wt %, preferably at least 30 wt %, for example 30 wt % to 90 wt %, relative to the total weight of the polyglycol. The end groups of the preferred polyglycol are preferably, independently of one another, hydroxide groups and/or C1-C20 alkoxide groups, preferably C1-C6 alkoxide groups. The alkoxide end groups can additionally be substituted. The end groups can be introduced during the production of the polyglycol by reacting the monomeric ethylene oxides with a monofunctional initiator. Monofunctional initiators are preferably water and alcohols, in particular butanol. Two or more chains of the polyglycol can also be linked via an end group. Alkyl groups are preferred as linking end groups. This can be done when producing the polyglycol from ethylene oxides using a nucleophilic difunctional or higher-functional initiator. Examples of difunctional initiators are diols, in particular 1,2-ethanediol.

Preferred esters are carboxylic esters, preferably monoesters, diesters, triesters, tetraesters, pentaesters, polyesters, preferably estolides. Diesters, triesters, tetraesters, pentaesters, polyesters, estolides, and mixtures thereof are preferred. Other preferred carboxylic esters are aromatic esters, preferably of aromatic C8-C20, preferably C8, C10, di-, tri-, or tetracarboxylic acids with, present alone or in a mixture, aliphatic C7 to C22 alcohols and aliphatic esters, preferably of aliphatic C4-C22 monocarboxylic acids and/or dicarboxylic acids with, individually or in mixtures, aliphatic mono-, di-, tri-, tetra-, penta-, hexa-alcohols having a carbon number of 3 to 22, preferably polyol esters, such as, preferably, complex esters, estolides, and mixtures thereof. The acid and/or alcohol component and/or hydroxycarboxylic acid component of the carboxylic esters preferably has/have, independently of one another, a number of carbon atoms from C3 to C54. Preferred acid components have a number of carbon atoms from C4 to C22, preferred alcohol components have a number of carbon atoms from C3 to C22, and/or preferred hydroxycarboxylic acid components have a number of carbon atoms from C14 to C22. Preferred diesters are diesters for which the acid component has less than 36 carbon atoms, preferably 6 carbon atoms to 20 carbon atoms, even more preferably 6 carbon atoms to 12 carbon atoms. The advantage of these esters is good solubility for the ionic liquid methyl trioctylammonium bis(fluorosulfonyl)imide.

Estolides are oligomeric aliphatic hydroxycarboxylic acids, preferably 12-hydroxystearic acid or oligomers of unsaturated carboxylic acids, preferably oleic acid, in which the terminal carboxylic acid group is esterified with a monoalcohol, di-alcohol, trialcohol, and/or tetraalcohol, preferably branched monoalcohols, most preferably Guerbet alcohols, and in which any free hydroxide groups can be esterified by reaction with monocarboxylic acids or dicarboxylic acids. Aliphatic esters of monocarboxylic acids and/or dicarboxylic acids having a carbon number of C3 to C20, preferably C6 to C20, with, present individually or in mixtures, a mono-, di-, tri-, tetra-, penta-, and/or hexa-alcohol having a carbon number of 3 to 22, are preferred.

In an embodiment, the ester is selected from the group consisting of aliphatic esters of aliphatic monocarboxylic acids having a carbon number of C5 to C22 with, present individually or in mixtures, an aliphatic tri-, tetra-, or hexa-alcohol having a carbon number of C3 to C10, in particular trimethylolpropane, pentaerythritol, and/or dipentaerythritol, and/or aliphatic esters of aliphatic dicarboxylic acids having a carbon number of C6 to C20 with, present individually or in mixtures, an aliphatic mono- and/or di-alcohol having a carbon number of 6 to 22, estolides and aromatic esters of aromatic tri- and tetracarboxylic acids with, individually or in mixtures, aliphatic C7 to C22 alcohols, and mixtures thereof.

Other base oils which are suitable according to the present disclosure contain the basic oil A in a mixture with a basic oil B. The basic oil B preferably has a solubility, at a room temperature of 20° C. for the ionic liquid methyl trioctylammonium bis(fluorosulfonyl)imide, of less than 3 wt %, for example of 0.01 wt % to 3 wt %, preferably of less than 2.5 wt %, for example of 0.01 wt % to 2.5 wt %, even more preferably of less than 2 wt %, for example of 0.01 wt % to 2 wt %, even more preferably of less than 1 wt %, for example of 0.01 wt % to 1 wt %.

In a further preferred embodiment, the basic oil B is a basic oil B1 which has an oxygen/carbon weight ratio of at most 0.1, for example of 0 to 0.1, and/or a basic oil B2 which has a proportion of halogens and/or silicon of more than 5 wt %, for example of 5 wt % to 30 wt %, preferably of 10 wt % to 25 wt %, relative to the total weight of the basic oil B2.

If the base oil contains the basic oil A in a mixture with a basic oil B, the proportion of the basic oil A is more than 50 wt %, for example from 50 to 90 wt %, even more preferably more than 60 wt %, for example from 60 to 85 wt %, in particular more than 70 wt %, for example from 70 to 85 wt %, relative to the total weight of the base oil.

Preferred basic oils B are selected from the group consisting of basic oils of groups I, II, II+, III, IV and from the subsequent basic oils of group V according to the classification of the American Petroleum Institute (API) [NLGI Spokesman, N. Samman, volume 70, number 11, pages 14 et seq.], namely diphenyl ethers, alkylated naphthalenes, polyisobutylenes, silicone oils, polytetrahydrofurans and oxetane polymers, polyalkylene glycols having ethylene units substituted with aliphatic and/or aromatic alkyl groups, wherein the proportion by weight of unsubstituted ethylene units in the polyalkylene glycols is less than 20 wt %, relative to the total weight of the polyalkylene glycol, and aliphatic esters of aliphatic dicarboxylic acids having a carbon number of C22 to C40, preferably C34 to C38, with, present individually or in mixtures, an aliphatic mono- and/or di-alcohol having a carbon number of 6 to 22, aliphatic esters of aliphatic tricarboxylic acids having a carbon number of C33 to C60, preferably C50 to C58, with, present individually or in mixtures, an aliphatic mono- and/or di-alcohol having a carbon number of 6 to 22, and mixtures thereof. Preferred basic oils are alkylated diphenyl ethers, polyisobutylenes, polyalphaolefins, and mixtures thereof. The basic oils can also be composed of mixtures of the aforementioned basic oils.

The proportion of the basic oil B, if present, is preferably less than 50 wt %, for example 10 to 49 wt %, even more preferably at most 40 wt %, for example 10 wt % to 40 wt %, in particular at most 30 wt %, for example 10 to 30 wt %, relative to the total weight of the base oil.

The proportion of the basic oil B, if present, is preferably at most 48 wt %, for example 5 to 48 wt %, even more preferably at most 40 wt %, for example 10 wt % to 40 wt %, in particular at most 30 wt %, for example 10 to 30 wt %, relative to the total weight of the lubricating grease composition.

The lubricating grease composition according to the present disclosure preferably has a kinematic viscosity at 40° C. of 20 $mm^2$/sec to 1500 $mm^2$/sec, preferably of 20 $mm^2$/sec to 320 $mm^2$/sec, even more preferably of 25 $mm^2$/sec to 220 $mm^2$/sec, even more preferably of 30 $mm^2$/sec to 150 $mm^2$/sec. The kinematic viscosity is determined in accordance with ASTM D 7042, version 2021.01.

According to the present disclosure, the proportion of the ionic liquid, the anion of which is bis(fluorosulfonyl)imide, is 0.5 wt % to 80 wt %, even more preferably 2 wt % to 40 wt %, even more preferably 2 wt % to 20 wt %, even more preferably 3 wt % to 15 wt %, and in particular 5 wt % to 10 wt %, relative to the total weight of the lubricating grease composition.

In a preferred embodiment, the base oil contains the basic oil A and the basic oil B in a weight ratio of basic oil A to basic oil B of at least 50:50, for example from 50:50 to 60:40, even more preferably of at least 60:40, for example from 60:40 to 70:30, even more preferably of at least 70:30, for example from 70:30 to 90:10, in particular of at least 80:20, for example from 80:20 to 90:10.

In a further preferred embodiment, the base oil contains the basic oil A and the basic oil B in a weight ratio of basic oil A to basic oil B of 50:50 to 60:40 and the proportion of ionic liquid, the anion of which is bis(fluorosulfonyl)imide (fsi), is 0.5 to 10 wt %, preferably 3 to 10 wt %, relative to the total weight of the lubricating grease composition, and/or in a weight ratio of basic oil A to basic oil B of 60:40 to 70:30 and the proportion of ionic liquid, the anion of which is bis(fluorosulfonyl)imide (fsi), is 0.5 to 15 wt %, preferably 3 wt % to 15 wt %, relative to the total weight of the lubricating grease composition, and/or in a weight ratio of basic oil A to basic oil B of 70:30 to 90:10 and the proportion of ionic liquid, the anion of which is bis(fluorosulfonyl)imide (fsi), is 0.5 wt % to 40 wt %, preferably 3 wt % to 20 wt %, relative to the total weight of the lubricating grease composition, and/or in a weight ratio of basic oil A to basic oil B of 80:20 to 90:10 and the proportion of ionic liquid, the anion of which is bis(fluorosulfonyl)imide (fsi), is 0.5 wt % to 80 wt % relative to the total weight of the lubricating grease composition.

In an embodiment of the present disclosure, the ionic liquid has a cation selected from the group consisting of symmetric and asymmetric ammonium ions, $NR_1R_2R_3R_4$+ and phosphonium ions $PR_1R_2R_3R_4$+. The groups $R_1$ to $R_4$ can be, independently of one another, branched or unbranched, substituted or unsubstituted $C_1$ to $C_{24}$, preferably $C_1$ to $C_{18}$, preferably $C_6$ to $C_{18}$ alkyl groups or $C_6$ to $C_{30}$ aryl groups. Preferred substituents are alkoxy, carboxy, amido, amino, thiocarboxy, carbamoyl, oxo, thioxo, and/or hydroxy.

Preferably, the groups $R_1$ to $R_4$ are selected such that they have a total of at least 10 carbon atoms, preferably at least 20 carbon atoms, even more preferably at least 25 carbon atoms.

In an embodiment of the present disclosure, the ionic liquid has one or more cations selected from the group consisting of: trihexyltetradecylphosphonium, tributyltetradecylphosphonium, tetraoctylphosphonium, trioctylmethylammonium, tributylmethylphosphonium, tributylphosphonium, and mixtures thereof. Trihexyltetradecylphosphonium, tributyltetradecylphosphonium, tetraoctylphosphonium and trioctylmethylammonium and mixtures thereof are preferred.

The lubricating grease composition according to the present disclosure can also comprise mixtures of different ionic liquids in which the anions are all bis(fluorosulfonyl)imide but the cations differ. The lubricating grease composition according to the present disclosure can also comprise additional ionic liquids, the anion of which is not bis(fluorosulfonyl)imide. In this case, the proportion of the additional ionic liquid is preferably 0.5 wt % to 5 wt %, relative to the total weight of the lubricating grease composition.

In an embodiment of the present disclosure, however, the lubricating grease composition does not contain any ionic liquids, the anion of which is not bis(fluorosulfonyl)imide. This is advantageous because using a plurality of ionic liquids increases the complexity of the production process and consequently increases production costs. More preferably, the lubricating grease composition does not contain any ionic liquid which contains bis(trifluoromethylsulfonyl)imide (bta) as the anion. This is advantageous for toxicological reasons. In an embodiment of the present disclosure, the lubricating grease composition does not comprise any ionic liquids, the anion of which is not bis(fluorosulfonyl)imide, or comprises such ionic liquids at most in a proportion of 0.5 wt % relative to the total weight of the lubricating grease composition. More preferably, the lubricating grease composition does not contain any ionic liquids which contain perfluoroalkyl groups, or contains ionic liquids which contain perfluoroalkyl groups in a proportion of at most 0.5 wt % relative to the total weight of the lubricating grease composition. This is advantageous for toxicological reasons.

In an embodiment of the present disclosure, the ionic liquid, the anion of which is bis(fluorosulfonyl)imide, is selected from the group consisting of:

P666(14) fsi, trihexyl(tetradecyl)phosphonium bis(fluorosulfonyl)imide

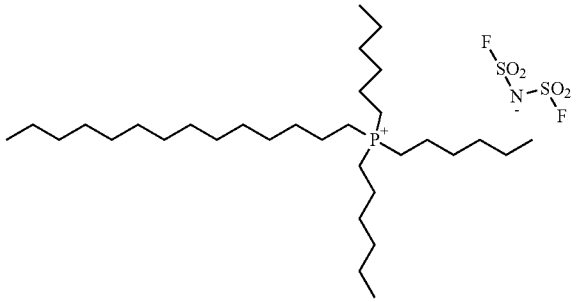

N1888 fsi, methyl trioctylammonium bis(fluorosulfonyl)imide

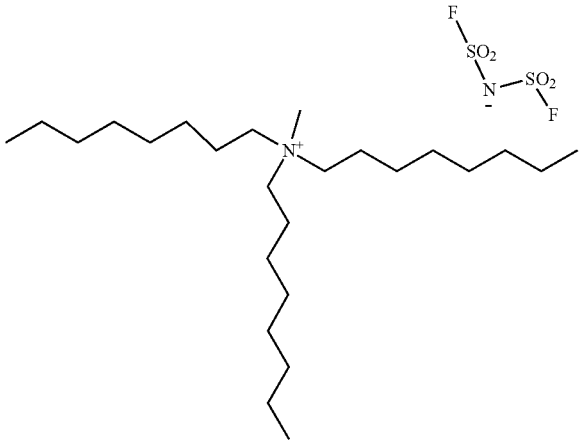

P444(14) fsi, tributyl tetradecylphosphonium bis(fluorosulfonyl)imide

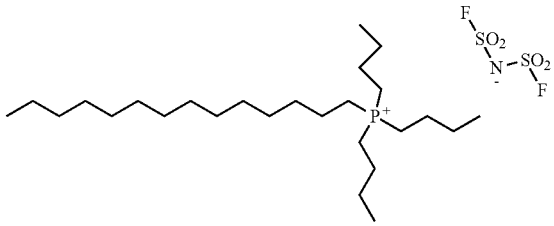

P8888 fsi, tetraoctylphosphonium bis(fluorosulfonyl)imide

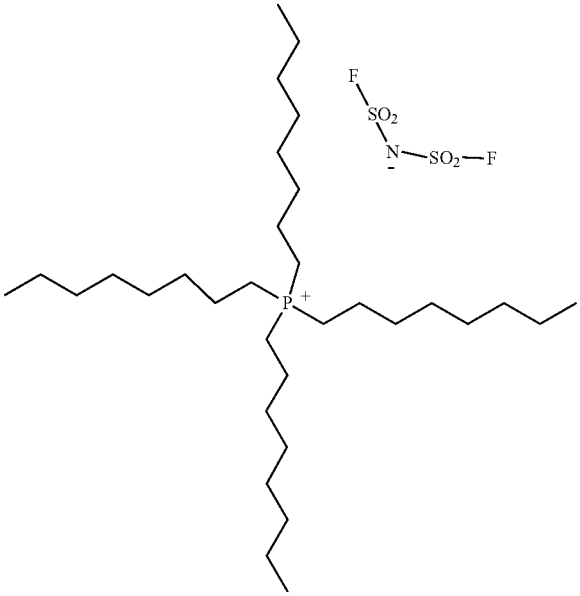

and mixtures thereof.

Using the ionic liquid in a lubricant composition which is in the form of a lubricating grease composition is particularly advantageous, since the positive effects on service life which can be attributed to the ionic liquid fsi are particularly apparent in lubricating greases, since there is usually a smaller quantity of lubricating grease at the point of lubrication than in the case of lubricating oils.

The lubricating grease composition preferably contains the thickener in a proportion of 4 to 30 wt %, in particular 6 to 20 wt %, in each case relative to the total weight of the lubricating grease composition.

Preferably, the worked penetration (in 1/10 mm) of the lubricating grease composition in the form of lubricating grease is between 400 and 200, even more preferably between 330 and 220, even more preferably between 300 and 250. The worked penetration is determined in accordance with DIN ISO 2137, version 2016.12.

According to the present disclosure, the thickener is selected from urea, lithium simple soaps, metal complex soaps of elements of the first and second main group of the periodic table, in particular lithium complex soaps, and mixtures thereof. Urea means reaction products of organic mono-, di-, tri-, and higher-functional isocyanates and/or mixtures thereof with aliphatic and/or aromatic mono-, di-, tri-, or higher-functional organic amines.

The advantage of ureas is that they can be used at high operating temperatures, and therefore the combination with the ionic liquid containing fsi as the anion leads to lubricating greases with particularly long service lives. A preferred urea is a reaction product of a diisocyanate, preferably toluene-2,4-diisocyanate, toluene-2,6-diisocyanate, 4,4'-diphenylmethane diisocyanate, 2,4'-diphenylmethane diisocyanate, 4,4'-diphenyl diisocyanate, 3,3'-dimethyldiphenyl-4,4'-diisocyanate, 3,3'-dimethylphenyl methane-4,4'-diisocyanate, which can be used individually or in combination, with an amine or diamine of general formula $(H_2N)xR$, where x=1 or 2 and R is an aryl, alkyl, cycloalkyl, or alkylene group having 2 to 22 carbon atoms, which are present individually or in combination.

In an embodiment, the urea is a diurea containing aliphatic, cycloaliphatic/aliphatic, and/or cycloaliphatic ureas.

In an embodiment, the urea is a diurea represented by formula A

Formula (A)

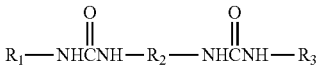

where $R_2$ is a divalent aromatic C6-15 hydrocarbon group, and $R_1$ and $R_3$, independently of one another, are a C6-20 cycloalkyl group, in particular a cyclohexyl group or a straight-chain or branched C8-20 alkyl group.

Diurea compounds which can preferably be used according to the present disclosure are described in DE112012001102A1.

Preferred diurea compounds are selected from:

an aliphatic urea of formula A:

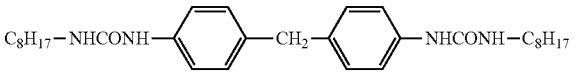

an aliphatic urea of formula B:

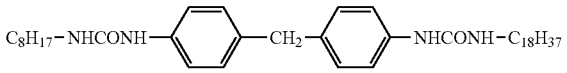

an aliphatic urea of formula C:

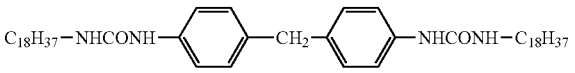

a cycloaliphatic/aliphatic urea of formula D:

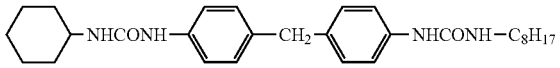

a cycloaliphatic/aliphatic urea of formula E:

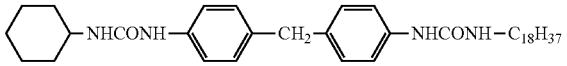

a cycloaliphatic/aliphatic urea of formula F:

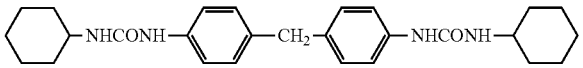

and mixtures thereof.

The alkyl groups in the ureas of formulas A-E are unbranched.

In a further embodiment, the thickener is selected from lithium simple soaps, metal complex soaps of elements of the first and second main group of the periodic table, in particular lithium complex soaps, and mixtures thereof.

Preferably, the lithium complex soap is a lithium complex soap produced starting from C4-C36 dicarboxylic acids, preferably azelaic acid, sebacic acid, suberic acid, terephthalic acid, dodecanedioic acid, and/or starting from higher-functional carboxylic acids having 3 or more, preferably 3 to 4, carboxylic acid groups, wherein the number of carbon groups can be 6 to 60, such as preferably citric acid and trimer acids, and/or starting from ester compounds, in particular methyl esters and/or triglycerides of one or more of the aforementioned acids, in each case combined with one or more monocarboxylic acids, preferably combined with one or more C4-C24 monocarboxylic acids, preferably stearic acid, hydroxystearic acid, in particular 12-hydroxystearic acid, palmitic acid, oleic acid, salicylic acid, ester compounds, in particular methyl esters and/or triglycerides of one or more of the aforementioned acids and/or combined with sebacic acid monostearyl amide and/or terephthalic acid monostearyl amide.

In a further embodiment, the lubricating grease composition contains 20 to 92.5 wt %, relative to the total weight of the lubricating grease composition, of the base oil, and 4 to 20 wt %, relative to the total weight of the lubricating grease composition, of a further thickener, preferably selected from aluminum complex soaps, bentonite, sulfonate, silicate, polyimide, and mixtures thereof.

The lubricating grease composition can also contain inorganic and/or organic solid lubricants. Preferred solid lubricants are selected from the group consisting of polytetrafluoroethylene (PTFE), molybdenum disulfide, graphite, graphene, (hexagonal) boron nitride, tin(IV) sulfide, tin(II) sulfide, tungsten disulfide, metal sulfide, phosphate, preferably calcium phosphate, carbonate, preferably calcium carbonate, metal oxide, preferably amorphous silicon dioxide, silicate and sheet silicate, talcum, mica, and mixtures thereof.

Preferred solid lubricants are selected from the group consisting of molybdenum disulfide, graphite, graphene, (hexagonal) boron nitride, tin(IV) sulfide, tin(II) sulfide, tungsten disulfide, metal sulfide, phosphate, preferably calcium phosphate, carbonate, preferably calcium carbonate, metal oxide, preferably amorphous silicon dioxide, silicate and sheet silicate, talcum, mica, and mixtures thereof.

If present, the proportion of solid lubricant in the lubricating grease composition according to the present disclosure is preferably 0.5 wt % to 23 wt %, even more preferably 0.5 wt % to 20 wt %, and in particular 0.5 wt % to 18 wt %, in each case relative to the total weight of the lubricating grease composition.

Furthermore, the lubricating grease can contain additives, for example additives against corrosion, oxidation (antioxidants) and for protecting against the influence of metals, for example chelating compounds, radical scavengers, UV stabilizers, reaction layer forming agents, viscosity enhancers, pour point depressants, adhesion promoters, and/or additives for reducing oil separation in greases.

Preferably, the proportion of additives in the lubricating grease composition according to the present disclosure is 0.5 wt % to 23 wt %, even more preferably 0.5 wt % to 20 wt %, even more preferably 1 wt % to 18 wt %, and in particular 1.5 wt % to 12 wt %, relative to the total weight of the lubricating grease composition. Additives in the form of phosphorus-containing, sulfur-containing, nitrogen-containing, and/or oxygen-containing compounds, polymers and/or mixtures thereof are preferably used. Preferred additives are aromatic amines, phenols, in particular alkylated phenols, triazoles, such as benzotriazoles, tolyltriazoles, esters, in particular sulfurated fatty acid esters, glycerol monoesters or diesters, sorbitan esters, thiadiazoles, dithiocarbamates, in particular molybdenum dithiocarbamates, phosphates, in particular thiophosphates, oligomeric phosphates, oligomeric thiophosphates, dithiophosphates, zinc dialkyl dithiophosphates, molybdenum dithiophosphates, aminophosphates, trialkylphosphates, triarylphosphates, phosphites, metal salts, carboxylic acids, polymers, in particular polymethacrylates, olefin copolymers, and/or mixtures thereof.

Aromatic amines, alkylated phenols, thiadiazoles, dithiocarbamates, triarylphosphates, aminophosphates, benzotriazoles, and/or mixtures thereof are especially preferred additives.

Preferred additives are aromatic amines because it has been found, surprisingly, that using them makes it possible to achieve a particularly potent delay in the induction of oxidation by the ionic liquid.

Aromatic amines preferred according to the present disclosure are styrenated diphenylamine, phenyl-alpha-naphthylamine, phenyl-beta-naphthylamine, octylated and/or butylated diphenylamine, in particular p,p'-dioctyldiphenylamine, nonylated diphenylamine. Thus, in an embodiment of the present disclosure, the lubricating grease composition comprises diphenylamine, in particular p,p'-dioctyldiphenylamine, as the antioxidant.

In an embodiment of the present disclosure, the lubricating grease composition comprises the additives in a proportion of 0.5 wt % to 23 wt %, even more preferably 0.5 wt % to 20 wt %, in particular 0.5 wt % to 10 wt %, relative to the total weight of the lubricating grease composition.

The lubricating grease composition is preferably characterized by a lower service temperature of no more than −30° C., for example from −60° C. to −30° C., preferably no more than-40° C., for example from −60° C. to −40° C., determined in accordance with IP 186, version 2015, and/or preferably an upper service temperature of at least +160° C., for example from 160° C. to 220° C., preferably at least +180° C., for example from 180° C. to 220° C., determined in accordance with DIN 51821 1+2, version 2016 July.

A further subject of the present disclosure relates to the use of the lubricating grease composition according to the present disclosure for lubricating drive elements, preferably rolling bearings, gears, plain bearings, actuators, and/or chains.

Drive elements, preferably rolling bearings, gears, plain bearings, actuators, and/or chains, to which electrical potentials are applied are preferred.

More preferable drive elements are rolling bearings, gears, plain bearings, actuators, and/or chains which are arranged in plants and machines for producing and conveying food, in wind turbines, in vehicles, preferably cars, in particular in hybrid and electric vehicles, in rail-borne vehicles, industrial plants, industrial robots, and/or in ships.

The drive elements are preferably selected from pulley bearings, fan bearings, vacuum pump bearings, rolling bearings of electric motors, in particular of hybrid and electric vehicles, generators, in particular of electric vehicles and rail-borne vehicles, wind turbines, industrial motors, auxiliary units in vehicles, and/or linkages of vehicles.

The lubricating grease composition is preferably used to lubricate rolling bearings of electric motors of hybrid and/or electric vehicles.

It is advantageous here that the lubricating grease composition according to the present disclosure exhibits a combination of properties that is particularly well suited to these uses. The good temperature stability is particularly advantageous in combination with the ability to discharge electrical potentials.

A further subject of the present disclosure relates to the use of the lubricating grease composition for lubricating drive elements, preferably rolling bearings, for which a lower service temperature of no more than −30° C., preferably from −60° C. to −30° C., preferably of no more than −40° C., for example from −60° C. to −30° C., determined in accordance with IP 186, version 2015, and/or preferably an upper service temperature of at least +160° C., for example from 160° C. to 220° C., even more preferably of at least +180° C., for example from 180° C. to 220° C., determined in accordance with DIN 51821 1+2, version 2016 July, are required.

The present disclosure will be described in more detail below using several examples which do not limit the invention.

Example 1

TGA measurements of the ionic liquids trihexyl(tetradecyl)phosphonium bis(fluorosulfonyl)imide (P666(14) fsi) and trihexyl(tetradecyl)phosphonium bis(trifluoromethylsulfonyl)imide (P666(14) bta) were taken and the values obtained were compared with one another.

TABLE 2

TGA evaporation loss under air and $N_2$

| TGA dynamic as per DIN 51006 | P666(14) bta | P666(14) fsi | P666(14) bta | P666(14) fsi |
|---|---|---|---|---|
| Heating rate | 1° C./min | | | |
| Purge gas | Air | | Nitrogen | |
| Antioxidant | None | | | |
| Crucible material | Aluminum | | | |
| Evaporation loss 120° C. % (m) | — | 0.6 | 0.6 | 0.1 |
| Evaporation loss 140° C. % (m) | — | 0.8 | 0.8 | 0.2 |
| Evaporation loss 160° C. % (m) | — | 0.9 | 1.0 | 0.3 |
| Evaporation loss 180° C. % (m) | 0.4 | 1.2 | 1.1 | 0.5 |
| Evaporation loss 200° C. % (m) | 0.5 | 2.4 | 1.2 | 1.0 |
| Evaporation loss 220° C. % (m) | 0.8 | 3.9 | 1.3 | 1.9 |
| Evaporation loss 240° C. % (m) | 1.4 | 6.7 | 1.5 | 3.6 |
| Evaporation loss 260° C. % (m) | 2.1 | 12.9 | 1.8 | 7.3 |

As expected, the TGA measurements show better temperature stability for P666(14) bta than P666(14) fsi. The evaporation loss values are lower for P666(14) bta for both the measurement with air and with N2. The better temperature stability of bta can be explained by the strong carbon-fluorine bond in the anion.

Example 2

DSC measurements of the ionic liquids trihexyl(tetradecyl)phosphonium bis(fluorosulfonyl)imide (P666(14) fsi) and trihexyl(tetradecyl)phosphonium bis(trifluoromethylsulfonyl)imide (P666(14) bta) were taken.

It can be seen in FIG. 1 that P666(14) fsi has an earlier onset and therefore lower stability than P666(14) bta.

Figure 2:
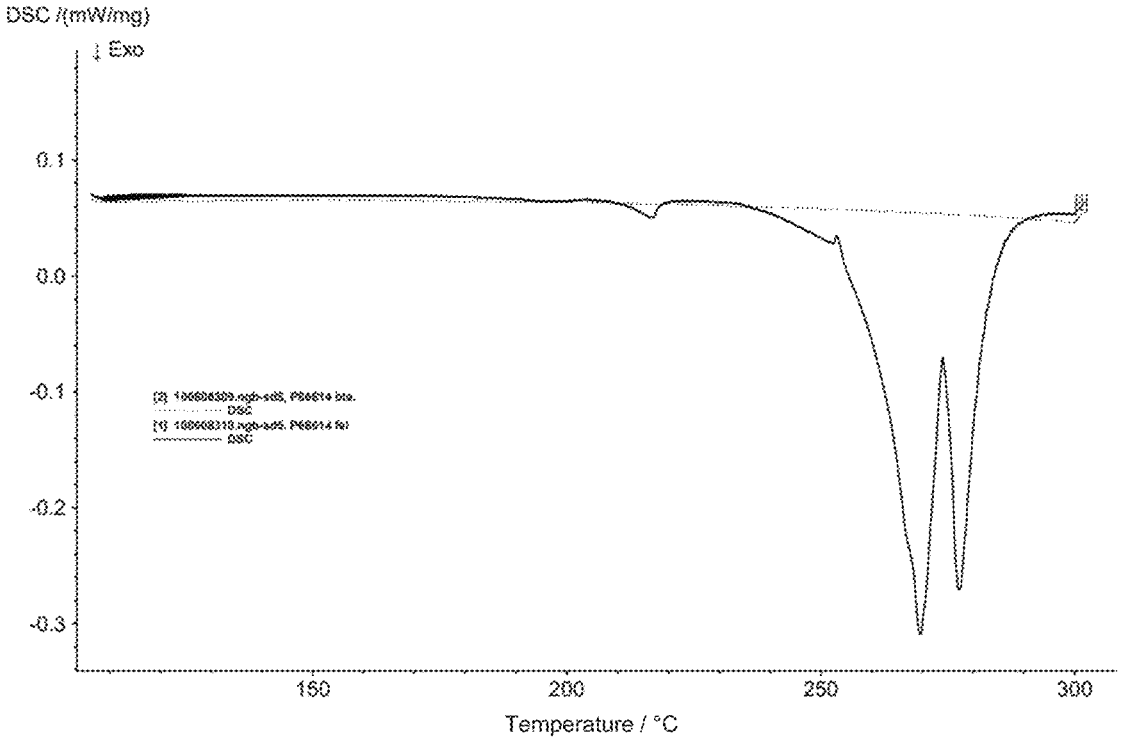
FIG. 2 shows results of DSC measurements under an $N_2$ atmosphere.

FIG. 2 shows that P666(14) fsi has a significant exothermal reaction around 270° C., but P666(14) bta does not. Both experiments confirm the lower thermal resistance of the ionic liquid having the fsi anion in the pure substance.

Example 3

To determine evaporation loss, trihexyl(tetradecyl)phosphonium bis(fluorosulfonyl)imide (P666(14) fsi) and trihexyl(tetradecyl)phosphonium bis(trifluoromethylsulfonyl)imide (P666(14) bta) were placed in cylindrical screw-top glass vessels (area of the base 1.5 $cm^2$, height 5 cm). 200 mg of each of the two ionic liquids were precisely weighed in. One glass vessel without a ball and one glass vessel with a ball (100Cr6 steel ball in accordance with DIN 51350-1, version 2015-03) were used for each of two testing temperatures. This was to verify if reactions took place between the metal of the ball and the ionic liquid in the glass vessel.

TABLE 3

Values at 150° C.

| | P666(14) bta | P666(14) fsi | P666(14) bta | P666(14) fsi |
|---|---|---|---|---|
| | without ball | | with ball | |
| Evaporation loss after 24 h [%] | 1.15 | −0.30 | 14.28 | 0 |
| Evaporation loss after 48 h [%] | 1.45 | −0.15 | 15.94 | 14.44 |
| Evaporation loss after 72 h [%] | 1.45 | −0.70 | 16.42 | 13.40 |
| Evaporation loss after 168 h [%] | 1.80 | −1.90 | 17.40 | 12.03 |

TABLE 4

Values at 180° C.

| | P666(14) bta | P666(14) fsi | P666(14) bta | P666(14) fsi |
|---|---|---|---|---|
| | without ball | | with ball | |
| Evaporation loss after 24 h [%] | 1.50 | 0.50 | 2.00 | 0 |
| Evaporation loss after 48 h [%] | 2.00 | 2.64 | 2.59 | 1.85 |
| Evaporation loss after 72 h [%] | 2.25 | 5.33 | 4.59 | 4.13 |
| Evaporation loss after 168 h [%] | 2.99 | 13.04 | 4.60 | 14.04 |

At a testing temperature of 150° C. there are differences in evaporation loss for both ionic liquids in the pure substance. For the samples without a ball, there is a continuous rise in the evaporation loss for P666(14) bta over the time period measured. In comparison, an overall weight increase can be observed for the values for the fsi samples. In the presence of the steel ball, P666(14) fsi exhibits lower evaporation loss than P666(14) bta. In the presence of the ball, both substances overall had significantly higher evaporation loss values. However, after an initial rise, the value for P666(14) fsi falls again toward the end.

The evaporation losses for both substances are naturally higher at 180° C. than at 150° C. In contrast, the change in values for P666(14) fsi at the lower testing temperature is unremarkable. Nevertheless, at the end of the time period it is higher than for P666(14) bta. Overall, the observed values can be understood such that, in addition to decomposition with mass loss, phenomena such as absorption/release of water, corrosion of the steel ball, and catalyzed decomposition are also involved. The tests of the substances in the pure form at 180° C. suggest that the resistance of the fsi-containing ionic liquid is lower than the resistance of the bta-containing ionic liquid.

Example 4

Production of two lubricating grease compositions according to the present disclosure and a comparative grease made from a base grease A.

Base grease A consists of 85 wt % of a trimellitate ester with C9-C11 alcohols, having an oxygen/carbon ratio of 0.20 and a base oil viscosity at 40° C. of approximately 72 $mm^2$/sec (TMSE-A), of 11 wt % of a urea thickener consisting of the reaction products of aliphatic saturated amines, aliphatic unsaturated amines, and aromatic amines with a mixture of MDI (4,4'-diphenylmethane diisocyanate) and TDI (mixture of toluene-2,4-diisocyanate and toluene-2,6-diisocyanate in a molar ratio of approximately 4:1). 0.5 wt % of p,p'-dioctyldiphenylamine and 3.5 wt % of further additives (anti-corrosion, anti-wear) were used as additives.

5 wt % of P666(14) fsi (grease 1 according to the present disclosure) or 5 wt % of P666(14) bta (comparative grease 2) was added to this base grease A, and the mixtures were homogenized using a three roll mill. 5 wt % of N1888 fsi was used in grease 3 according to the present disclosure and incorporated identically.

Compared with the base grease A, the electrical resistivity is lower by approximately 3 powers of ten. Surprisingly, grease 1 according to the present disclosure exhibits an approximately 50% better service life at 180° C. than comparative grease 2, which does not contain an ionic liquid according to the present disclosure. The grease according to the present disclosure also complies with the service life requirements of DIN 51821 1+2 at 200° C.

| Method | Standard | Unit | Grease 1 according to the present disclosure | Comparative grease 2 |
|---|---|---|---|---|
| General data | | | | |
| Appearance, color | Visual | | Beige | Beige |
| Worked penetration 60 DT | DIN ISO 2137 | 1/10 mm | 269 | 278 |
| Dropping point | DIN ISO 2176 | ° C. | 262 | 268 |
| Karl Fischer water content | | % | 0.05 | 0.06 |
| Behavior after working | | | | |
| Prolonged worked penetration after 100,000 DT | DIN ISO 2137 | 1/10 mm | +40 | +53 |
| Low-temperature behavior | | | | |
| Flow pressure at −45° C. | DIN 51805 | mBar | 675 | 650 |
| Oil separation | | | | |
| Oil separation after 30 h/150° C. | ASTM D 6184 | wt % | 3.7 | 2.8 |
| Oil separation after 168 h/40° C. | DIN 51817 | wt % | 2.1 | 1.6 |
| Upper service temperature | | | | |
| FAG FE 9 6000 rpm, 1500 N, 180° C., B, version 2016-07 | DIN 51821 1 + 2 | h | L 10: 691 h<br>L 50: 694 h | L 10: 423 h<br>L 50: 457 h |
| FAG FE 9 6000 rpm, 1500 N, 200° C., B, version 2016-07 | DIN 51821 1 + 2 | h | L 10: 113 h<br>L 50: 249 h | |
| Resistance to media | | | | |
| Water resistance, static, 3 h/90° C. | DIN 51807 | | 0 | 0 |
| SKF Emcor, distilled water | As per DIN 51802 | | 0 | 0 |
| Corrosion behavior | | | | |
| Copper corrosion 24 h/160° C. | DIN 51811 | | 1 | 1 |

-continued

| Method | Standard | Unit | Grease 1 according to the present disclosure | Comparative grease 2 |
|---|---|---|---|---|
| Noise behavior | | | | |
| SKF BeQuiet+ | As per ÖNorm M8127 | | GN3 | GN3 |
| Electrical conductivity | | | | |
| Electrical resistivity | As per DIN 53482 | Ohm*cm | $3.18 * 10^6$ | $3.81 * 10^6$ |

| Method | Requirements | Grease 1 according to the present disclosure | Grease 3 according to the present disclosure | Base grease A |
|---|---|---|---|---|
| FAG FE 9 6000 rpm, 1500N, 200° C., B, DIN 51821 1 + 2, version 2016-07 | L 50 > 100 h | L 10: 113 h L 50: 249 h | L 10: 105 h L 50: 146 h | L 10: 60 h L 50: 90 h |

In the testing of the service life at 200° C., grease 1 according to the present disclosure exhibits a significant increase in the service life achieved, in terms of the L 50 value, by more than a factor of 2.5. Grease 3 according to the present disclosure also exhibits an increase in the service life of 50% compared with base grease A.

Example 5

Several lubricating grease compositions according to the present disclosure and a comparative grease made from a base grease B were produced.

Base grease B consists of:

84.5 wt % trimellitate ester having linear C8 and C10 alkyl groups present in an approximate (molar) ratio of 1:1 (TMSE-B) having an oxygen/carbon ratio of 0.22, 13.5 wt % urea thickener produced by reacting MDI (4,4'-diphenylmethane diisocyanate) and octylamine in a (molar) ratio of 1.2, 1 wt % p,p'-dioctyldiphenylamine, 1 wt % calcium sulfonate anti-corrosion additive.

| | Content base grease B | N1888 fsi (wt %) | P666614 fsi wt % | FAG FE 9 6000 rpm, 1500N, 200° C., B, DIN 51821 1 + 2, version 2016-07 |
|---|---|---|---|---|
| Base grease B | 100 | | | L 10 = 145 h L 50 = 187 h β = 7.4 |
| Grease 4 according to the present disclosure | 99 | 1 | | L 10 = 92 h L 50 = 219 h β = 2.2 |
| Grease 5 according to the present disclosure | 97 | 3 | | L 10 = 83 h L 50 = 141 h β = 3.5 |
| Grease 6 according to the present disclosure | 95 | 5 | | L 10 = 203 h L 50 = 261 h β = 7.5 |
| Grease 7 according to the present disclosure | 90 | 10 | | L 10 = 139 h L 50 = 229 h β = 3.8 |
| Grease 8 according to the present disclosure | 97 | | 3 | |

Grease 6 according to the present disclosure exhibits an increase in the service life of approximately 50% compared with base grease B (comparative grease) while giving a very steep failure curve (high β values). Grease 7 according to the present disclosure exhibits an increase in the service life of approximately 40%.

All the greases according to the present disclosure meet the requirement of DIN 51821 1+2 at 200° C., since the L 50 value is above 100 h. As a result, it is possible to lower the electrical resistance (see table below) while retaining an upper service temperature of 200° C.

| | Electrical resistivity [ohm*cm], 10 V DC voltage as per DIN 53482 | Worked penetration, 60 round-trip strokes [1/10 mm] DIN ISO 2137 |
|---|---|---|
| Base grease B | $2.85 * 10^9$ | 242 |
| Grease 4 according to the present disclosure | $3.51 * 10^7$ | 249 |
| Grease 5 according to the present disclosure | $5.98 * 10^6$ | 256 |
| Grease 6 according to the present disclosure | $2.35 * 10^6$ | 263 |
| Grease 7 according to the present disclosure | $7.49 * 10^5$ | 261 |
| Grease 8 according to the present disclosure | $5.51 * 10^6$ | 254 |

The electrical resistivity is significantly lowered by adding ionic liquid P666(14) fsi. In contrast, the worked penetration only changes to a small extent, showing that the thickening effect is not disrupted by the ionic liquid.

Example 6

The electrical resistivity of mixtures of P666(14) fsi and P666(14) bta in a polyglycol was measured.

A polyglycol having a kinematic viscosity of 220 $mm^2$/sec was used as polyglycol A. This is a random copolymer of ethylene oxide and propylene oxide at a (molar) ratio of 1:1 with glycol as the initiator. The oxygen/carbon ratio was 0.53.

| | | | | | |
|---|---|---|---|---|---|
| Content polyglycol A (wt %) | 100 | 99 | 97 | 65 | 90 |
| Content P666(14) fsi (wt %) | 0 | 1 | 3 | 5 | 10 |
| Resistivity [Mohm * cm] | 7.10 | 0.41 | 0.13 | 0.079 | 0.031 |

| | | | | | |
|---|---|---|---|---|---|
| Content polyglycol A (wt %) | 100 | 99 | 97 | 65 | 90 |
| Content P666(14) bta (wt %) | 0 | 1 | 3 | 5 | 10 |
| Resistivity [Mohm * cm as per DIN 53482] | 7.10 | 0.68 | 0.22 | 0.13 | 0.056 |

The tables show that the lubricant composition having P666(14) fsi leads to lower resistivities than P666(14) bta. It can be derived therefrom that lubricating grease compositions containing the aforementioned basic oil A will also have their resistivity lowered by the addition of P666(14) fsi.

This was surprising because, as shown in the table below, the viscosities of P666(14) fsi are higher than those of P666(14) bta.

| | P666(14) fsi | P666(14) bta |
|---|---|---|
| Viscosity at 40° C. [$mm^2$/s] | 152.9 | 147.4 |
| Viscosity at 100° C. [$mm^2$/s] | 19.87 | 18.33 |
| VI | 150 | 139 |
| Density at 20° C. [$g/cm^3$] | 1.014 | 1.077 |
| Density at 100° C. [$g/cm^3$] | 0.963 | 1.020 |

This suggests that in fsi the ion pair is actually more strongly bonded together, i.e. is less mobile, and therefore should exhibit lower conductivities. However, as shown above, this is surprisingly not the case.

Example 7

The influence of N1888 fsi on the thermal oxidation resistance of an ester oil was investigated.

Trimellitate ester B (trimellitate ester having linear C8 and C10 alkyl groups in an approximate (molar) ratio of 1:1) was used as the base oil, and p,p'-dioctyldiphenylamine was used as the amine antioxidant (amine AO). The trimellitate ester B is a basic oil A.

| | Name | | | | | | | |
|---|---|---|---|---|---|---|---|---|
| | Oil 1 | | Oil 2 | | Oil 3 | | Oil 4 | |
| | Amine AO | | | | | | | |
| | 1 | | 1 | | 3 | | 3 | |
| | N1888 fsi | | | | | | | |
| | 0 | | 1 | | 1 | | 3 | |
| | TMSE-B | | | | | | | |
| | 99 | | 98 | | 96 | | 94 | |
| TGA, air, temperature gradient 1 K/min | 180 | 0.1 | 180 | 0.1 | 180 | 0.3 | 180 | 0.1 |
| | 200 | 0.2 | 200 | 0.3 | 200 | 0.4 | 200 | 0.3 |
| | 220 | 0.5 | 220 | 0.5 | 220 | 0.8 | 220 | 0.7 |
| | 240 | 1.2 | 240 | 1.2 | 240 | 1.7 | 240 | 1.8 |
| | 260 | 3.2 | 260 | 3.2 | 260 | 4.0 | 260 | 4.6 |
| | 280 | 9.7 | 280 | 8.4 | 280 | 9.3 | 280 | 11.1 |
| | 300 | 50.1 | 300 | 38.6 | 300 | 26.6 | 300 | 29.7 |

-continued

| | Name | | | |
|---|---|---|---|---|
| | Oil 1 | Oil 2 | Oil 3 | Oil 4 |
| | Amine AO | | | |
| | 1 | 1 | 3 | 3 |
| | N1888 fsi | | | |
| | 0 | 1 | 1 | 3 |
| | TMSE-B | | | |
| | 99 | 98 | 96 | 94 |
| DSC, O2, temperature gradient 1 K/min | Oxidation induction 204.5 Onset 242.5 | Oxidation induction 256.7 Onset 269.1 | Oxidation induction 240.2 1st onset 261.2 2nd onset 276.5 | Oxidation induction 239.5 Onset 283.2 |
| Open crucible test 230° C., 24/48/72 h Loss [%] | 43.24 63.22 79.76 (paint) | 29.64 54.92 69.63 (thick oil, slightly grainy) | 22.38 36.58 48.82 (oil, grainy) | 23.02 34.28 53.03 (oil, very grainy) |
| Shear viscosity | | | | |
| Start | 108 | 113 | 119 | 125 |
| 24 h | 1355 | 266 | 209 | 208 |
| 48 h | 33800 | 1320 | 391 | 298 |
| 72 h | | 12150 | 647 | |
| Resistivity [ohm*cm] as per DIN 53482 | $3.43 * 10^{12}$ | $3.26 * 10^{10}$ | $2.95 * 10^{10}$ | $2.60 * 10^{10}$ |

| | Name | | | | | |
|---|---|---|---|---|---|---|
| | Oil 5 | | Oil 6 | | Oil 7 | |
| | Amine AO | | | | | |
| | 0 | | 0 | | 3 | |
| | N1888 fsi | | | | | |
| | 3 | | 1 | | 0 | |
| | TMSE-B | | | | | |
| | 97 | | 99 | | 97 | |
| TGA, air, temperature gradient 1 K/min | 180 | 0.1 | 180 | 0.3 | 180 | 0.3 |
| | 200 | 0.2 | 200 | 0.5 | 200 | 0.5 |
| | 220 | 0.7 | 220 | 0.9 | 220 | 0.9 |
| | 240 | 2.0 | 240 | 1.9 | 240 | 1.9 |
| | 260 | 8.4 | 260 | 4.4 | 260 | 4.2 |
| | 280 | 21.7 | 280 | 20.2 | 280 | 10.6 |
| | 300 | 49.2 | 300 | 51.8 | 300 | 45.3 |
| DSC, O2, temperature gradient 1 K/min | Oxidation induction 223.7 1st onset 234.1 2nd onset 264.0 | | Oxidation induction 224.7 Onset 231.8 | | Oxidation induction 205.7 Onset 253.9 | |
| Open crucible test 230° C., 24/48/72 h Loss [%] | 36.26 56.86 73.04 (tar-like) | | 38.49 59.95 77.04 (rubbery) | | 28.30 53.14 67.23 (tar-like) | |
| Shear viscosity | | | | | | |
| Start | 116 | | 109 | | 117 | |
| 24 h | 577 | | 920 | | 405 | |
| 48 h | 3550 | | 11950 | | 7630 | |
| 72 h | 110500 | | | | 42100 | |
| Resistivity [ohm*cm] as per DIN 53482 | $3.08 * 10^{10}$ | | $4.99 * 10^{10}$ | | $1.38 * 10^{13}$ | |

The shear viscosity was determined at 25° C. at a shear rate of 300 1/s in accordance with DIN 53019-1,3. The open crucible test was performed with evaporation crucibles made of aluminum having a diameter of 50 mm. 5 g+/−0.1 g were weighed in. The measurement was performed in a convection oven. The measurement was performed over 24/48/72 h. The evaporation loss was determined and the shear viscosity measured in each case.

Oils 2, 3, 4, 5, and 6 are lubricant compositions from which lubricating grease compositions according to the present disclosure can be obtained by combination with the thickener.

If the samples which only contain P666(14) fsi (oils 6 and 5) are compared with the samples which only contain amine AO (oils 1 and 7), it is clear that the induction of oxidation is more greatly delayed by the ionic liquid.

A highly positive influence on the evaporation losses in TGA up to 300° C., on the induction and onset of oxidation in DSC, and on the evaporation values in the open crucible test (see for example the evaporation values after 24 h) are exhibited by the samples in which the amine antioxidant p,p'-dioctyldiphenylamine is combined with P666(14) fsi.

Example 8

Solubility tests were performed for N1888fsi in base oils containing basic oils of various polarities. The results are given in the following tables.

| Base oil: PAO 8/trimellitate ester B having linear C8 and C10 alkyl groups (ratio of the two basic oils = 60:40). | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | 2-phase | 2-phase | 2-phase |
| V 40 [$mm^2/s$] | 44.789 | 46.035 | — | — | — |
| V 100 [$mm^2/s$] | 7.58 | 7.73 | — | — | — |
| VI | 136 | 136 | — | — | — |
| Density 40° C. g/ml | 0.8675 | 0.8692 | — | — | — |
| Density 100° C. g/ml | 0.8286 | 0.8300 | — | — | — |
| Resistivity [Ω * cm] | $1.60 * 10^{11}$ | $1.73 * 10^{8}$ | — | — | — |

PAO 8 has an oxygen/carbon ratio of 0.
Trimellitate ester B has an oxygen/carbon ratio of 0.22.
This gives an oxygen/carbon ratio of 0.088 for the base oil.

The basic oil mixture described here is not suitable for producing a lubricating grease composition according to the present disclosure, since the proportion of basic oil A is not high enough, and as a result the solubility of N1888fsi is too low.

| Base oil: PAO 8/trimellitate ester B having linear C8 and C10 alkyl groups (ratio of the two basic oils = 30:70). | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | clear | clear | clear |
| V 40 [$mm^2/s$] | 46.608 | 47.900 | 50.759 | 53.966 | 63.845 |
| V 100 [$mm^2/s$] | 7.68 | 7.81 | 8.14 | 8.53 | 9.66 |
| VI | 132 | 131 | 132 | 132 | 133 |
| Density 40° C. g/ml | 0.9105 | 0.9118 | 0.9140 | 0.9163 | 0.9217 |
| Density 100° C. g/ml | 0.8698 | 0.8710 | 0.8733 | 0.8754 | 0.8811 |
| Resistivity [Ω * cm] | $1.25 * 10^{11}$ | $4.84 * 10^{7}$ | $5.73 * 10^{6}$ | $1.48 * 10^{6}$ | $3.36 * 10^{5}$ |

PAO 8 has an oxygen/carbon ratio of 0.
Trimellitate ester B has an oxygen/carbon ratio of 0.22.
This gives an oxygen/carbon ratio of 0.15 for the base oil.

The basic oil mixture described here is suitable for producing a lubricating grease composition according to the present disclosure, since the proportion of basic oil A is sufficient, and as a result the solubility of N1888fsi is sufficient.

| Base oil: PAO 8/trimellitate ester B having linear C8 and C10 alkyl groups (ratio of the two basic oils = 20:80). | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | clear | clear | clear |
| V 40 [$mm^2/s$] | 47.839 | 49.129 | 51.802 | 54.932 | 63.716 |
| V 100 [$mm^2/s$] | 7.77 | 7.90 | 8.20 | 8.56 | 9.53 |
| VI | 130 | 130 | 130 | 130 | 130 |
| Density 40° C. g/ml | 0.9259 | 0.9270 | 0.9289 | 0.9309 | 0.9358 |
| Density 100° C. g/ml | 0.8846 | 0.8857 | 0.8877 | 0.8896 | 0.8947 |
| Resistivity [Ω * cm] | $9.55 * 10^{10}$ | $3.31 * 10^{7}$ | $3.89 * 10^{6}$ | $1.17 * 10^{6}$ | $3.05 * 10^{5}$ |

PAO 8 has an oxygen/carbon ratio of 0.
Trimellitate ester B has an oxygen/carbon ratio of 0.22.
This gives an oxygen/carbon ratio of 0.18 for the base oil.

The basic oil mixture described here is suitable for producing a lubricating grease composition according to the present disclosure, since the proportion of basic oil A is sufficient, and as a result the solubility of N1888fsi is sufficient.

| Base oil: Trimellitate ester B having linear C8 and C10 alkyl groups. | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | clear | clear | clear |
| V 40 [$mm^2/s$] | 51.173 | 56.315 | 55.093 | 58.045 | 66.018 |
| V 100 [$mm^2/s$] | 7.99 | 8.41 | 8.41 | 8.74 | 9.58 |
| VI | 125 | 121 | 125 | 126 | 125 |
| Density 40° C. g/ml | 0.9587 | 0.9594 | 0.9612 | 0.9626 | 0.9663 |
| Density 100° C. g/ml | 0.9162 | 0.9171 | 0.9186 | 0.9202 | 0.9241 |
| Resistivity [Ω * cm] | $9.54 * 10^{10}$ | $1.54 * 10^{7}$ | $1.85 * 10^{6}$ | $6.55 * 10^{5}$ | $1.92 * 10^{5}$ |

Trimellitate ester B has an oxygen/carbon ratio of 0.22.

| Base oil: Trimellitate ester B having linear C8 and C10 alkyl groups | | | | |
|---|---|---|---|---|
| | Quantity N1888 fsi | | | |
| | 20 wt % | 40 wt % | 60 wt % | 80 wt % |
| Visual assessment (clear/2-phase) | clear | clear | clear | clear |
| V 40 [$mm^2/s$] | 84.201 | 125.240 | 167.340 | 200.530 |
| V 100 [$mm^2/s$] | 11.31 | 14.77 | 18.34 | 21.32 |
| VI | 123 | 120 | 122 | 126 |
| Density 40° C. g/ml | 0.9734 | 0.9883 | 0.9626 | 1.0173 |
| Density 100° C. g/ml | 0.9872 | 0.9472 | 1.0158 | 0.9780 |
| Resistivity [Ω * cm] | $6.98 * 10^{4}$ | $2.74 * 10^{4}$ | $2.35 * 10^{4}$ | $2.08 * 10^{4}$ |

The basic oil described here is suitable for producing a lubricating grease composition according to the present disclosure, since the proportion of basic oil A is sufficient, and as a result the solubility of N1888fsi is very good.

The examples show that the ionic liquid N1888fsi is miscible with the trimellitate ester over a very broad concentration range.

| Base oil: Propylene oxide homopolymer (non-polar), butanol-initiated, kinematic viscosity at 40° C. of approximately 120 $mm^2$/sec, oxygen/carbon ratio of 0.44 | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | 2-phase | 2-phase | 2-phase | 2-phase |
| V 40 [$mm^2/s$] | — | — | — | — | — |
| V 100 [$mm^2/s$] | — | — | — | — | — |
| VI | — | — | — | — | — |
| Density 40° C. g/ml | — | — | — | — | — |
| Density 100° C. g/ml | — | — | — | — | — |
| Resistivity [Ω * cm] | — | — | — | — | — |

The basic oil described here is not suitable for producing a lubricating grease composition according to the present disclosure, since there is no proportion of basic oil A, and as a result the solubility of N1888fsi is insufficient.

| Base oil: Propylene oxide homopolymer (non-polar), butanol-initiated, kinematic viscosity at 40° C. of approximately 120 $mm^2$/sec. | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | clear | clear | clear |
| V 40 [$mm^2/s$] | 82.62 | 84.02 | 86.92 | 90.15 | 98.79 |
| V 100 [$mm^2/s$] | 13.85 | 13.97 | 14.20 | 14.64 | 15.51 |
| VI | 173 | 172 | 170 | 170 | 167 |
| Density 40° C. g/ml | 0.9675 | 0.9682 | 0.9693 | 0.9708 | 0.9741 |
| Density 100° C. g/ml | 0.9241 | 0.9249 | 0.9263 | 0.9278 | 0.9312 |
| Resistivity [Ω * cm] | $1.32 * 10^{10}$ | $1.18 * 10^{7}$ | $2.02 * 10^{6}$ | $7.91 * 10^{5}$ | $2.13 * 10^{5}$ |

Trimellitate ester B having linear C8 and C10 alkyl groups (polar), 50:50 mixing ratio in percentage by weight.
Oxygen/carbon ratio of 0.22 of the base oil is 0.33.

The basic oil mixture described here is suitable for producing a lubricating grease composition according to the present disclosure, since the proportion of basic oil A is sufficient, and as a result the solubility of N1888fsi is sufficient.

| Base oil: Hydrogenated dimer acid (non-polar), alcohol component: 2-ethylhexanol. Oxygen/carbon ratio of 0.10. | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | 2-phase | 2-phase | 2-phase |
| V 40 [$mm^2/s$] | 102.61 | 103.93 | — | — | — |
| V 100 [$mm^2/s$] | 14.33 | 14.40 | — | — | — |
| VI | 143 | 142 | — | — | — |
| Density 40° C. g/ml | 0.8934 | 0.8947 | — | — | — |
| Density 100° C. g/ml | 0.8548 | 0.8561 | — | — | — |
| Resistivity [Ω * cm] | $1.36 * 10^{11}$ | $2.75 * 10^{8}$ | — | — | — |

The basic oil described here is not suitable for producing a lubricating grease composition according to the present disclosure, since there is no proportion of basic oil A, and as a result the solubility of N1888fsi is insufficient.

| Polyethylene glycol, molar mass 200 (polar). Oxygen/carbon ratio of 0.66. | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | clear | clear | clear | Clear |
| V 40 [$mm^2/s$] | 22.33 | 22.46 | 22.80 | 23.14 | 24.17 |
| V 100 [$mm^2/s$] | 4.16 | 4.19 | 4.23 | 4.28 | 4.40 |
| VI | 77 | 79 | 80 | 82 | 84 |
| Density 40° C. g/ml | 1.1088 | 1.1081 | 1.1064 | 1.1048 | 1.1004 |
| Density 100° C. g/ml | 1.0610 | 1.0603 | 1.0588 | 1.0573 | 1.0534 |
| Resistivity [Ω * cm] | $8.54 * 10^{3}$ | $1.86 * 10^{3}$ | $8.68 * 10^{2}$ | $5.95 * 10^{2}$ | $3.37 * 10^{2}$ |

The basic oil described here is suitable for producing a lubricating grease composition according to the present disclosure, since only basic oil A is present, and as a result the solubility of N1888fsi is sufficient.

It is clear that N1888fsi is also readily soluble in larger quantities in base oils having a proportion of over 50 wt % of polar basic oil. The polar basic oils are produced from esters and polyalkylene glycols that are produced with ethylene oxide as a constituent of the reaction mixture.

Example 9

A base grease C was produced, and a grease 9 not according to the present disclosure was produced therefrom.

| | Content base grease C | N1888 fsi (wt %) | FAG FE 9 6000 rpm, 1500N, 160° C., A, DIN 51821 1 + 2, version 2016-07 |
|---|---|---|---|
| Base grease C | 100 | | L 10 = 164 h L 50 = 236 h β = 7.4 |
| Grease 9 not according to the present disclosure | 97 | 3 | L 10 = 167 h L 50 = 207 h β = 8.7 |

Base grease C belongs to NLGI class 1. The base oil has a kinematic viscosity of 130 $mm^2/sec$ at 40° C. and is a non-polar mixture of mineral oil/PAO. The oxygen/carbon ratio is virtually 0. The thickener is a mixture of urea/calcium complex soap. Customary additives for oxidation stabilization, for improving load-bearing capacity, and for protecting against corrosion are also present. No improvement in the service life is achieved by adding the ionic liquid; the L 50 value is even lowered. It is clear that no improvement is achieved by using the ionic liquid in greases which have a non-polar basic oil (mineral oil and PAO).

Example 10

A lubricating grease D having the following composition was produced:

- 41 wt % trimellitate ester A having C9-C11, V 40 approximately 72 $mm^2/sec$ (oxygen/carbon ratio of 0.20)
- 17 wt % PIB, Mn approximately 1300 g/mol determined using GPC (oxygen/carbon ratio of 0.0)
- 20 wt % alkylated diphenyl ether, V 40 approximately 100 $mm^2/sec$ (oxygen/carbon ratio of 0.04)
- 13 wt % lithium complex thickener composed of azelaic acid/12-hydroxystearic acid
- 4 wt % amine antioxidant
- 5 wt % additive package: anti-corrosion, AW and EP The proportion by weight of the trimellitate ester A relative to the whole base oil is 52.6 wt %.

| Method General data | Standard | Unit | Example grease D + 3% N1888 fsi according to the present disclosure | Example grease D, comparative grease |
|---|---|---|---|---|
| Worked penetration 60 DT | DIN ISO 2137 | 1/10 mm | 283 | 273 |
| Dropping point | DIN ISO 2176 | ° C. | Greater than 300° C. | Greater than 300° C. |
| Flow pressure at −40° C. | DIN 51805 | mBar | 537 | 825 |
| Oil separation after 30 h/150° C. | ASTM D 6184 | wt % | 7.3 | 5.8 |
| Resistivity | As per DIN 53482 | [ohm * cm] | $9.68 * 10^{7}$ | $3.88 * 10^{10}$ |
| Evaporation loss, 24 h/180° C. | DIN 58397 | % | 15.6 | 11.4 |
| Shear viscosity at 25° C., shear rate 300 1/s, fresh | DIN 53019-1,3 | mPas | 5300 | 5800 |
| Shear viscosity at 25° C., shear rate 300 1/s, after evaporation loss testing 24 h/180° C. in accordance with DIN 58397 | DIN 53019-1,3 | mPas | 3660 | 5935 |

The composition according to the present disclosure is advantageous in terms of reducing resistivity, low-temperature behavior (flow pressure), and preventing hardening on storage at 180° C. (no increase in dynamic viscosity).

Example 11: Solubility Test of N1888 Fsi in an Estolide Basic Oil

| Estolide basic oil, homopolymer 12-hydroxystearic acid, esterified with 2-ethylhexanol, kinematic viscosity at 40° C. of approximately 148 $mm^2/s$, oxygen/carbon ratio of 0.17. | | | | | |
|---|---|---|---|---|---|
| | Quantity N1888 fsi | | | | |
| | 0 wt % | 1 wt % | 3 wt % | 5 wt % | 10 wt % |
| Visual assessment (clear/2-phase) | clear | Clear | clear | clear | clear |
| V 40 [$mm^2/s$] | 148.35 | 149.84 | 153.81 | 159.24 | 184.61 |
| V 100 [$mm^2/s$] | 21.5 | 21.6 | 21.9 | 22.7 | 24.9 |
| VI | 170 | 170 | 169 | 171 | 167 |
| Density 40° C. g/ml | 0.8990 | 0.9004 | 0.9028 | 0.9051 | 0.9111 |
| Density 100° C. g/ml | 0.8598 | 0.8610 | 0.8634 | 0.8658 | 0.8719 |
| Resistivity [Ω * cm] | $2.63 * 10^{10}$ | $8.83 * 10^{7}$ | $7.72 * 10^{6}$ | $2.35 * 10^{6}$ | $5.37 * 10^{5}$ |

In the concentration range tested, N1888 fsi is soluble in the estolide basic oil. The resistivity drops as the quantity of ionic liquid increases.

Discussion of Experimental Results

Overall, it was possible to determine that lubricating grease compositions containing ionic liquids based on fsi as the anion achieve performance values in the ranges of a product additized with ionic liquids based on bta. Thus, fsi-based ionic liquids are a good alternative to ionic liquids containing bta. Furthermore, fsi-based additives have the advantage over additives containing bta that they do not contain any persistent CFx groups.

In the tests in which P666(14) fsi was investigated in the pure form, the results showed, as expected, a lower thermal stability compared with P666(14) bta. This can mainly be explained by the fact that the anion lacks strong carbon-fluorine bonds, which has an overall effect on the stability of the molecule.

Surprisingly, the difference in performance between the two ionic liquids is significantly lower when they are used as an additive in grease. The values for the examined properties show that P666(14) fsi has very similar performance in the tested grease system to P666(14) bta. Requirements regarding high-temperature and low-temperature properties and electrical conductivity can be met in the temperature ranges considered with the fsi material as an additive.

Furthermore, the lubricating grease composition according to the present disclosure also makes it possible to meet requirements regarding corrosion stability.

Overall, it was possible to demonstrate that, in terms of their performance, lubricating grease compositions comprising fsi-based ionic liquids are a good alternative to lubricating grease compositions comprising ionic liquids containing bta. Furthermore, the lubricating grease compositions according to the present disclosure do not contain any persistent CFx groups and are therefore biodegradable. Test Methods Unless otherwise indicated, a Stabinger viscometer was used for determining the kinematic viscosity at 40° C. and 100° C., the viscosity index, and the densities at 40° C. and 100° C., as per ASTM D 7042, version 2021.01.

Determination of carbon content: ASTM D 5291:2021 was used to determine the carbon content.

JPI-5S-68-11 was used to determine the oxygen contents.

The oxygen/carbon weight ratio was obtained from the proportion by weight of oxygen (wt %), determined in accordance with JPI-5S-68-11, divided by the proportion of carbon (wt %), determined in accordance with ASTM D 5291:2021.

To determine the solubility of the ionic liquid N1888 fsi in the basic oils or base oils, the basic oil(s) that form the base oils were initially charged into a glass beaker, and N1888 fsi was added in the relevant concentration. The mixture was stirred for 10 minutes at 60° C. by means of a magnetic stirrer. After cooling to room temperature, the mixtures were visually assessed and the resistance determined. N1888 fsi is insoluble in basic oil or base oil at a certain concentration if the turbidity measurement as per DIN EN ISO 7027-1:2016-11 at 25° C. gives a turbidity value which is more than 1 FNU higher than in the pure basic oil or base oil. Likewise, N1888 fsi is insoluble in basic oil or base oil at a certain concentration if two or more phases form. N1888 fsi is soluble in basic oil or base oil at a certain concentration if the turbidity measurement as per DIN EN ISO 7027-1:2016-11 at 25° C. gives a turbidity value which is at most 1 FNU higher than in the pure basic oil or base oil.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A lubricating grease composition, comprising:

a) 20 to 96.5 wt %, relative to a total weight of the lubricating grease composition, of a base oil, the base oil containing a base oil A in a proportion of at least 50 wt %, relative to a total weight of the base oil, wherein the base oil A is an ester and/or a polyglycol;

b) 0.5 to 80 wt %, relative to the total weight of the lubricating grease composition, of an ionic liquid, the anion of which is bis(fluorosulfonyl)imide; and c) 3 to 35 wt %, relative to the total weight of the lubricating grease composition, of a thickener selected from urea, lithium simple soaps, metal complex soaps of elements of the first and second main group of the periodic table, and mixtures thereof.

2. The lubricating grease composition according to claim 1, wherein the base oil has a solubility, at a room temperature of 20° C., for ionic liquid methyl trioctylammonium bis(fluorosulfonyl)imide of at least 3 wt %, and/or the base oil A has a solubility, at a room temperature of 20° C., for the ionic liquid methyl trioctylammonium bis(fluorosulfonyl)imide of at least 3 wt %.

3. The lubricating grease composition according to claim 1, wherein the base oil A is present in a proportion of 70 to 100 wt % relative to the total weight of the base oil.

4. The lubricating grease composition according to claim 1, wherein a proportion of the base oil, relative to the total weight of the lubricating grease composition, is 40 wt % to 95 wt %.

5. The lubricating grease composition according to claim 1, wherein the proportion of the base oil A, relative to the total weight of the lubricating grease composition, is 10 wt % to 96.5 wt %.

6. The lubricating grease composition according to claim 1, wherein the ester has an oxygen/carbon weight ratio of more than 0.1 and/or the polyglycol has an oxygen/carbon weight ratio of more than 0.44.

7. The lubricating grease composition according to claim 1, wherein the polyglycol is selected from homopolymers of ethylene oxide as a sole monomer and/or copolymers having unsubstituted ethyl groups and 1-methylethyl groups as the carbon groups in the repeating unit, wherein a proportion by weight of unsubstituted ethylene units in the copolymers is at least 20 wt % relative to a total weight of the polyglycol, and wherein end groups of the polyglycols are, independently of one another, hydroxide groups and/or C1-C20 alkoxide groups.

8. The lubricating grease composition according to claim 1, wherein the ester is selected from carboxylic esters, estolides, and mixtures thereof.

9. A lubricating grease composition according to claim 1, wherein the ester is selected from a group consisting of aliphatic esters of aliphatic monocarboxylic acids having a carbon number of C5 to C22 with, present individually or in mixtures, an aliphatic tri-, tetra-, or hexa-alcohol having a carbon number of C3 to C10 and/or aliphatic esters of aliphatic dicarboxylic acids having a carbon number of C6 to C20 with an aliphatic mono- and/or di-alcohol having a carbon number of 6 to 22, estolides and aromatic esters of aromatic tri- and tetracarboxylic acids with one, or a mixture of, aliphatic C7 to C22 alcohols, and mixtures thereof.

10. The lubricating grease composition according to claim 1, wherein the base oil contains the base oil A in a mixture with a base oil B, the base oil B having a solubility, at a room temperature of 20° C., for the ionic liquid methyl trioctylammonium bis(fluorosulfonyl)imide of less than 3 wt %.

11. The lubricating grease composition according to claim 10, wherein the base oil B is a base oil B1 which has an oxygen/carbon weight ratio of at most 0.1 or wherein the base oil B is a base oil B2 which has a proportion of halogens and/or silicon of more than 5 wt %, relative to the total weight of the base oil B2, or base oil B is a mixture of the base oil B1 and the base oil B2.

12. The lubricating grease composition according to claim 10, wherein the base oil B is selected from a group consisting of base oils of groups I, II, II+, III, IV and from the subsequent base oils of group V according to the classification of the American Petroleum Institute, polyalkylene glycols having ethylene units substituted with aliphatic and/or aromatic alkyl groups, wherein a proportion by weight of unsubstituted ethylene units in the polyalkylene glycols is less than 20 wt %, relative to a total weight of the polyalkylene glycol, and aliphatic esters of aliphatic dicarboxylic acids having a carbon number of C22 to C40 with, present individually or in mixtures, an aliphatic mono- and/or di-alcohol having a carbon number of 6 to 22, aliphatic esters of aliphatic tricarboxylic acids having a carbon number of C33 to C60, and mixtures thereof.

13. The lubricating grease composition according to claim 10, wherein a proportion of the base oil B is at most 48 wt % relative to the total weight of the lubricating grease composition, and/or a weight ratio of base oil A to base oil B is at least 50:50.

14. The lubricating grease composition according to claim 10, wherein a weight ratio of base oil A to base oil B is 50:50 to 60:40 and a proportion of ionic liquid, the anion of which is bis(fluorosulfonyl)imide, is 0.5 to 10 wt % relative to the total weight of the lubricating grease composition, and/or the weight ratio of base oil A to base oil B is 60:40 to 70:30 and the proportion of ionic liquid, the anion of which is bis(fluorosulfonyl)imide, is 0.5 to 15 wt % relative to the total weight of the lubricating grease composition, and/or the weight ratio of base oil A to base oil B is 70:30 to 90:10 and the proportion of ionic liquid, the anion of which is bis(fluorosulfonyl)imide, is 0.5 to 40 wt % relative to the total weight of the lubricating grease composition, and/or the weight ratio of base oil A to base oil B is 80:20 to 90:10 and the proportion of ionic liquid, the anion of which is bis(fluorosulfonyl)imide, is 0.5 wt % to 80 wt % relative to the total weight of the lubricating grease composition.

15. The lubricating grease composition according to claim 1, wherein the lubricating grease composition has a kinematic viscosity at 40° C. of 20 $mm^2$/sec to 1500 $mm^2$/sec.

16. The lubricating grease composition according to claim 1, wherein the ionic liquid has a cation selected from a group consisting of symmetric and asymmetric ammonium ions, $NR_1R_2R_3R_4$+ and phosphonium ions $PR_1R_2R_3R_4$+, the groups $R_1$ to $R_4$, independently of one another, being branched or unbranched, substituted or unsubstituted $C_1$ to $C_{24}$.

17. The lubricating grease composition according to claim 1, wherein the lubricating grease composition does not contain any ionic liquids of which the anion is not bis (fluorosulfonyl)imide, or contains ionic liquids of which the anion is not bis (fluorosulfonyl)imide, in a proportion of at most 0.5 wt % relative to the total weight of the lubricating grease composition.

18. The lubricating grease composition according to claim 1, wherein the lubricating grease composition does not comprise any ionic liquids which contain perfluoroalkyl groups, or contains ionic liquids which contain perfluoroalkyl groups in a proportion of at most 0.5 wt % relative to the total weight of the lubricating grease composition.

19. The lubricating grease composition according to claim 1, wherein the ionic liquid, the anion of which is bis (fluorosulfonyl)imide, is selected from a group consisting of:

trihexyl(tetradecyl)phosphonium bis(fluorosulfonyl) imide

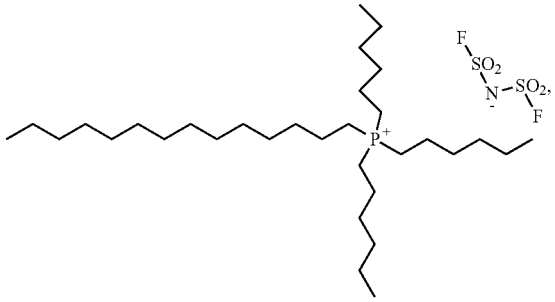

methyl trioctylammonium bis(fluorosulfonyl)imide

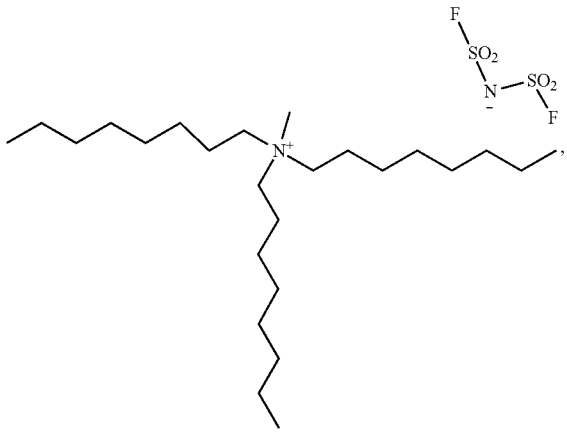

tributyl tetradecylphosphonium bis(fluorosulfonyl)imide

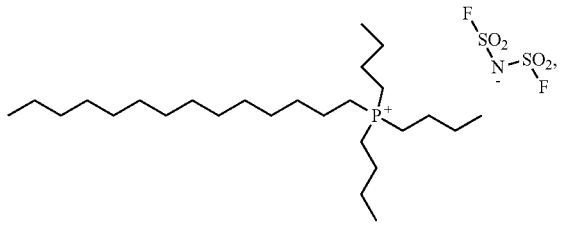

tetraoctylphosphonium bis(fluorosulfonyl)imide

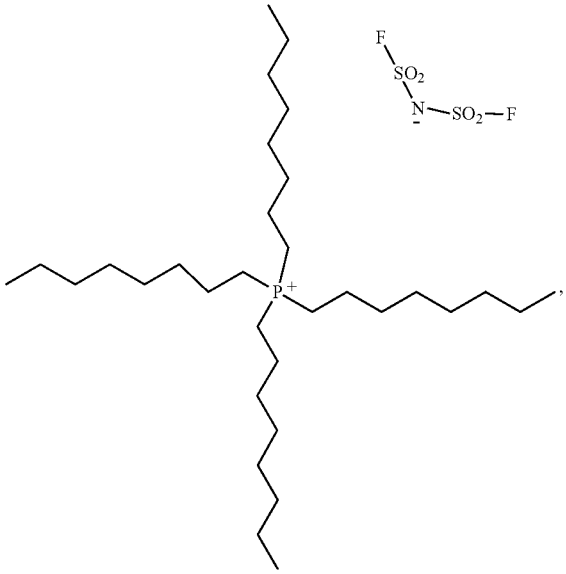

and mixtures thereof.

20. The lubricating grease composition according to claim 1, wherein a proportion of thickener is 4 to 30 wt % relative to the total weight of the lubricating grease composition.

21. The lubricating grease composition according to claim 1, wherein the lubricating grease composition contains 20 to 92.5 wt %, relative to the total weight of the lubricating grease composition, of base oil, and 4 to 20 wt %, relative to the total weight of the lubricating grease composition, of a further thickener selected from aluminum complex soaps, bentonite, sulfonate, silicate, polyimide, and mixtures thereof.

22. The lubricating grease composition according to claim 1, wherein the urea is a urea which is a reaction product of a diisocyanate, preferably toluene-2,4-diisocyanate, toluene-2,6-diisocyanate, 4,4'-diphenylmethane diisocyanate, 2,4'-diphenylmethane diisocyanate, 4,4'-diphenyl diisocyanate, 3,3'-dimethyldiphenyl-4,4'-diisocyanate, 3,3'-dimethylphenyl methane-4,4'-diisocyanate, which can be used individually or in combination, with an amine or diamine of general formula $(H_2N)xR$, where x=1 or 2 and R is an aryl, alkyl, cycloalkyl, or alkylene group having 2 to 22 carbon atoms, which are present individually or in combination.

23. The lubricating grease composition according to claim 1, wherein the urea is a diurea containing aliphatic, cycloaliphatic/aliphatic, and/or cycloaliphatic ureas, the diurea represented by formula A Formula (A)

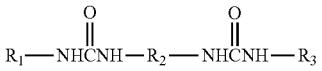

where $R_2$ is a divalent aromatic C6-15 hydrocarbon group, and $R_1$ and $R_3$, independently of one another, are a C6-20 cycloalkyl group, a cyclohexyl group or a straight-chain or branched C8-20 alkyl group.

24. The lubricating grease composition according to claim 1, wherein the lithium complex soap is a lithium complex soap produced starting from C4-C36 dicarboxylic acids and/or starting from higher-functional carboxylic acids having 3 or more carboxylic acid groups, with a number of carbon groups being 6 to 60.

25. The lubricating grease composition according to claim 1, wherein the lubricating grease composition contains, as an additive, an aromatic amine.

26. The lubricating grease composition according to claim 1, wherein a lower service temperature of no more than −30° C. in accordance with IP 186, version 2015, and/or an upper service temperature of at least +160° C. in accordance with DIN 51821 1+2, version 2016 July.

27. The lubricating grease composition according to claim 1, wherein the base oil A is an ester and/or a polyglycol containing unsubstituted ethylene units as a carbon group in a repeating unit.

* * * * *